United States Patent [19]

Lichtenwalter

[11] Patent Number: 5,055,061

[45] Date of Patent: Oct. 8, 1991

[54] CIRCUIT CARD GUIDE

[75] Inventor: Guy Lichtenwalter, San Jose, Calif.

[73] Assignee: Hewlett-Packard Company, Palo Alto, Calif.

[21] Appl. No.: 573,638

[22] Filed: Aug. 27, 1990

[51] Int. Cl.[5] ..... H01R 13/635

[52] U.S. Cl. ..... 439/377; 211/41; 361/415; 439/64

[58] Field of Search ..... 439/59, 61, 62, 64, 439/377; 211/41, 45; 361/399, 415

[56] References Cited

U.S. PATENT DOCUMENTS 3,231,785 1/1966 Calabro ..... 439/64 X
3,950,057 4/1976 Calabro ..... 361/415 X
4,019,099 4/1977 Calabro ..... 361/399
4,214,292 7/1980 Johnson ..... 361/415 X

*Primary Examiner*—Eugene F. Desmond
*Attorney, Agent, or Firm*—Roland I. Griffin; Alan H. Haggard

[57] ABSTRACT

A card guide for positioning a circuit card relative to a backplane is disclosed. The card guide provides electrical contacts to a ground plane on the circuit card in addition to positioning the card. The card guide utilizes two types of protuberances to reduce the force needed when the card is inserted or removed from the card guide, while providing accurate mating of paired connectors.

4 Claims, 3 Drawing Sheets

CIRCUIT CARD GUIDE

FIELD OF THE INVENTION

The present invention relates to electrical equipment in which printed circuit cards are connected to a backplane, and more particularly, to an improved card guide for aligning the circuit card during insertion and for providing ground connections to said circuit card.

BACKGROUND OF THE INVENTION

Electrical apparatuses often include optional accessories which are provided on a plug-in circuit card and attached to the apparatus by inserting the card into a connector on a motherboard within the apparatus. For example, many computer designs have processor and, or memory boards and the like which are connected to the computer by insertion into a connector on a motherboard.

Connections between the card and motherboard are made by mating a connector on the card to a corresponding connector on the motherboard. As circuit complexity increases, the number and density of pins and sockets on the connectors increases. As the density increases, the accuracy with which the card must be positioned relative to the connector on the motherboard also increases. To provide this accuracy, card guides are normally positioned relative to the connector on the motherboard. The circuit card slides in the card guide which provides the proper alignment during card insertion.

The card guides are also used for providing additional ground connections. Typically, the edge of the circuit card that slides in the guide has a plated section which is connected to the ground bus on the circuit card. Spring loaded protrusions on the card guide engage this plated section. The protrusions in question are connected to the ground bus of the motherboard.

In prior art designs, the card guide utilizes the same set of protrusions both for positioning the card relative to the motherboard and for making the ground connections. To provide sufficient accuracy in aligning the circuit card, the card guide must present a substantially rigid "slot" to the circuit card. The slot must have a width which is very close to the thickness of the circuit card. However, to provide the electrical connections described above, the protrusions must contact the card with sufficient force to assure a good electrical connection.

To accomplish both of these goals, prior art devices have employed spring loaded protrusions disposed on each side of the slot. The protrusions are designed such that the spacing between opposing protrusions is less than the thickness of the circuit card when no circuit card is inserted in the slot. When the circuit card is inserted in the slot, the protrusions are forced apart by the insertion motion. The circuit card is then caused to slide between the protrusions until the connectors are engaged.

Since the protrusions must restrict the lateral motion of the circuit card relative to the slot, the force generated by the protrusions on the sides of the circuit card must be sufficient to prevent the circuit card from moving in a lateral direction. Such a force is significantly greater than the force needed to assure electrical contact between the protrusions and the plated region on the circuit card. In fact, the force required to make prior art card guides function properly is so large, that it hampers the insertion and removal of the circuit cards.

Broadly, it is the object of the present invention to provide an improved printed circuit card guide.

It is a further object of the present invention to provide a circuit card guide having reduced insertion force than prior art devices while providing ground connections for the circuitry on the card.

These and other objects of the present invention will be apparent to those skilled in the art from the following detailed description of the invention and the accompanying drawings.

SUMMARY OF THE INVENTION

The present invention comprises a channel guide for positioning a circuit card which engages the card guide along an edge thereof, the edge of said circuit card having a predetermined thickness. The channel guide includes a means for defining a first channel having left and right walls and a width greater than said predetermined thickness. A plurality of first resilient protuberances are positioned along at least one of said left and right walls. The first protuberances define a second channel having a width substantially equal to said predetermined thickness. A second resilient electrically conducting protuberance is positioned along one of said left and right walls. The second protuberance is positioned such that said protuberance is forced toward the wall on which said protuberance is positioned when said circuit card is inserted into said channel guide.

DETAILED DESCRIPTION OF THE INVENTION

Figure 1:
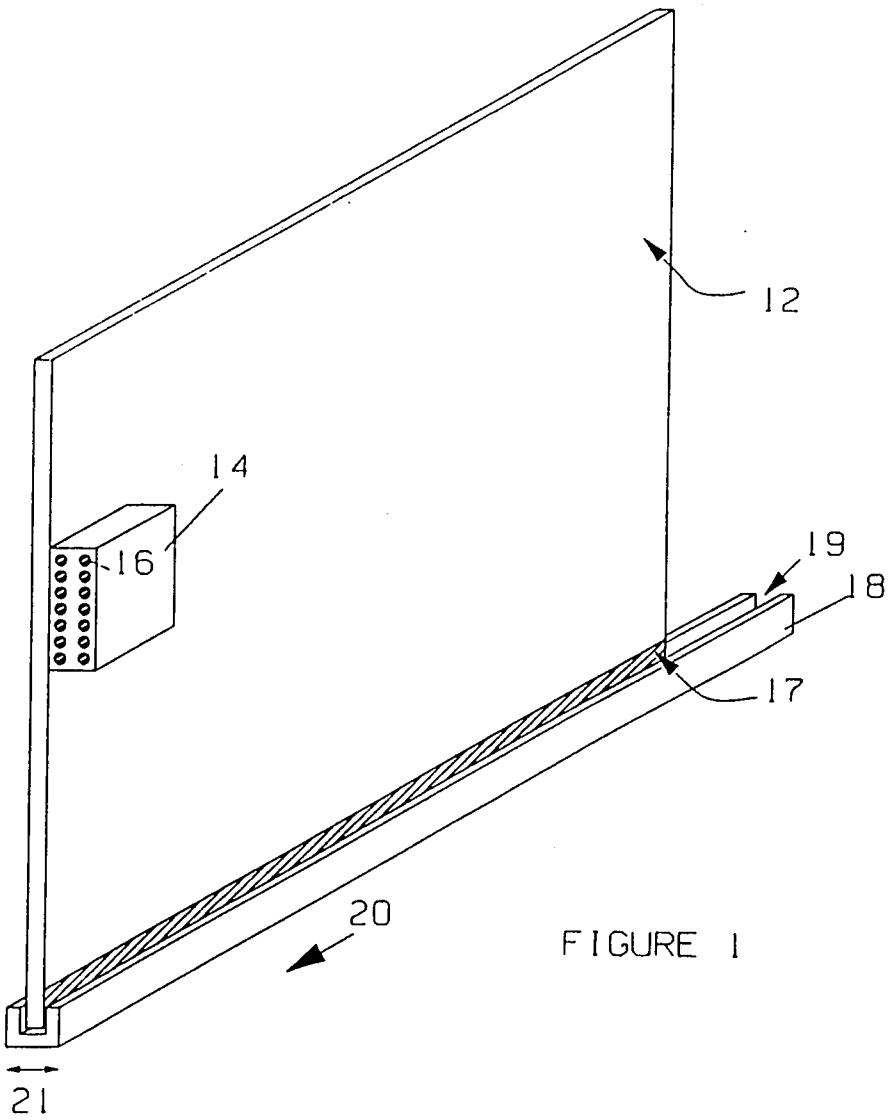
FIG. 1 is a perspective view of a circuit card 12 in a card guide 18 according to the present invention.

The manner in which the present invention provides its advantages may be more easily understood with reference to FIG. 1 which is a perspective view of a circuit card 12 in a card guide 18 according to the present invention. Circuit card 12 includes a connector 14 having a plurality of receptacles of which receptacle 16 is typical. Each receptacle engages a pin on a mating connector which is typically affixed to a backplane. To simplify the drawing, the mating connector and backplane have been omitted. For the purposes of this discussion, it is sufficient to note that the number of pins and receptacles can be quite large. As a result, the accuracy with which the connectors are brought together when connector 14 on circuit card 12 engages the mating connector must be very high. If the connectors are not properly aligned, the pins on the mating connector may be damaged.

Card guide 18 serves to align the two connectors. The connectors are engaged by sliding circuit card 12 through the slot 19 in card guide 18 in the direction shown by arrow 20. It should be noted that two card guides are typically used, one on the top of circuit card 12 and one on the bottom. To simplify the drawing, the top card guide has been omitted. The degree to which circuit card 12 can move perpendicular to slot 19 in card guide 18 determines the accuracy with which the connectors are mated. The perpendicular direction is indicated by the arrows shown at 21. Hence, it is important that slot 19 provide a channel whose width is essentially the same as the thickness of circuit card 12. However, if the width of slot 19 exactly matches the thickness of circuit card 18, variations in the thickness of circuit card 18 would lead to circuit card 12 binding in slot 19 as circuit card 12 is inserted therein.

Card guide 18 also provides a means for making electrical connections between a plated region 17 on circuit card 12 and the ground bus on the motherboard. As the frequency of operation of the electronics housed on circuit card 12 increases, the need for better ground connections also increases. One method for providing such ground connections utilizes spring loaded electrically conducting contacts in the card guide.

Figure 2:
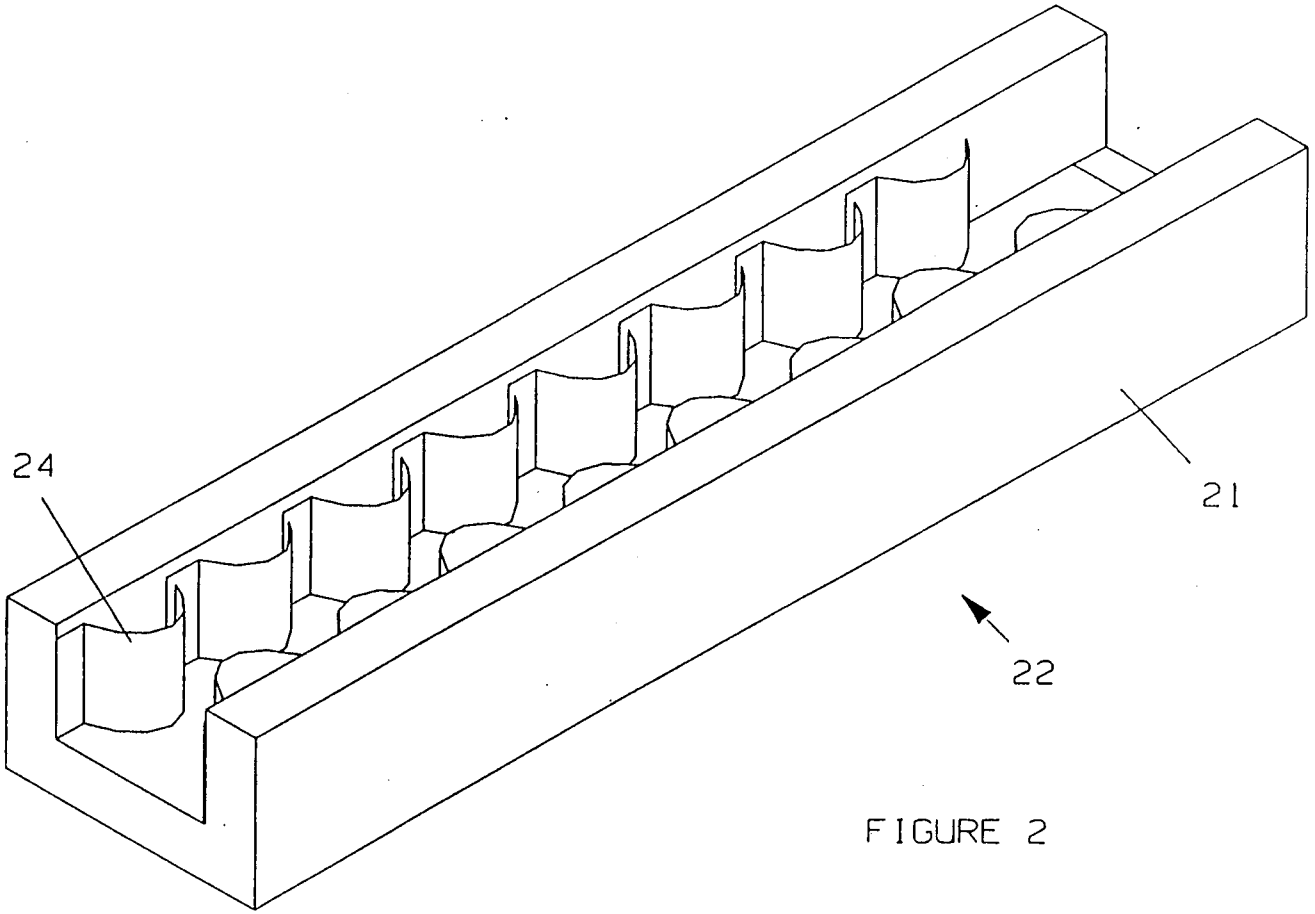
FIG. 2 is a perspective view of the preferred embodiment of a card guide 22 according to the present invention.

The manner in which the alignment and electrical connections are provided by a card guide according to the present invention may be more easily understood with reference to FIG. 2 which is a perspective view of the preferred embodiment of a card guide 22 according to the present invention. Card guide 22 is constructed from a channel 21. Card guide 22 includes a plurality of resilient protuberances of which protuberance 24 is typical. Two types of protuberances are utilized. The first type of protuberances define a channel having a width substantially the same as the thickness of the circuit card. The second type of protuberances provide the electrical contacts described above. The protuberances preferably consist of spring fingers constructed from stainless steel or a beryllium copper alloy. While the two types of protuberances shown in FIG. 2 appear similar in shape, it will be apparent to those skilled in the art that different shapes may be used for the first and second types of protuberances.

Figure 3:
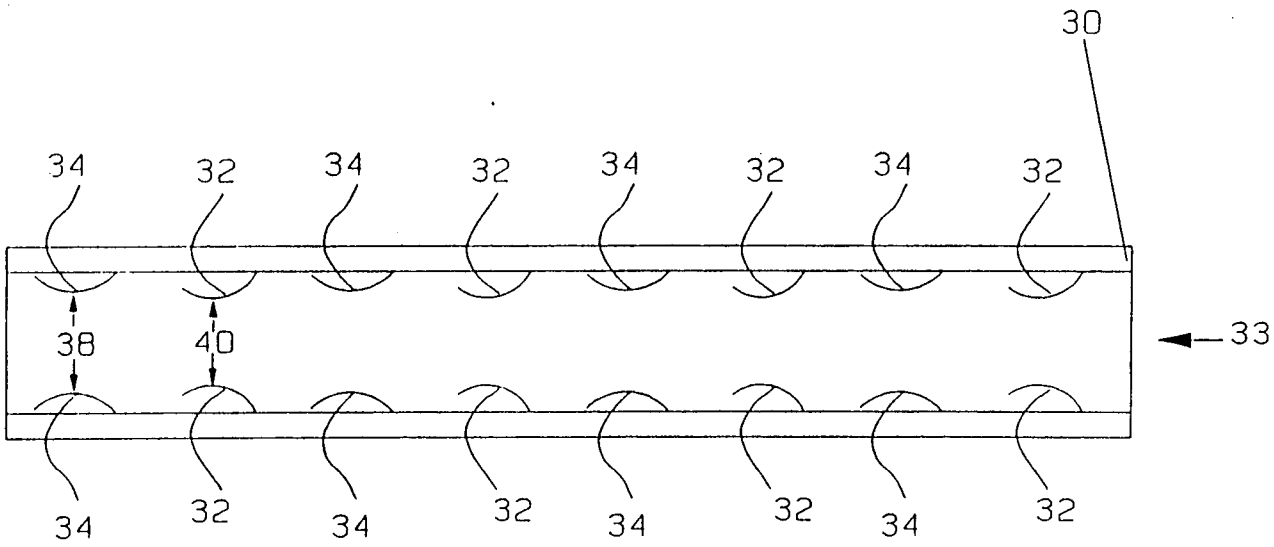
FIG. 3 is a top view of the preferred embodiment of a card guide 30 according to the present invention.

The manner in which these protuberances provide the above described functionality may be better understood with reference to FIG. 3 which is a top view of the preferred embodiment of a card guide 30 according to the present invention. Card guide 30 includes two types of spring fingers, 32 and 34. In the preferred embodiment of the present invention, these fingers are disposed in opposing pairs along the sides of the slot 33 in card guide 30. Spring fingers 34 provide positioning accuracy for the circuit card. The distance 38 between the opposing spring fingers is substantially the same as the thickness of the circuit card. The spring constant of spring fingers 34 is sufficiently large to prevent the circuit card from moving a substantial distance perpendicular to slot 33. However, the spring constant is small enough to allow sufficient motion to accommodate small irregularities in the the circuit card.

Spring fingers 32 provide electrical connections to the circuit card. The distance between opposing spring fingers 32 is less than the thickness of the circuit card when no circuit card is inserted in slot 33. Upon insertion of the circuit card, spring fingers 32 are forced apart, thereby creating a spring force engaging each spring finger with the surface of the circuit card. The spring constant of spring fingers 32 is less than that of spring fingers 34 but sufficient to provide enough force to assure good electrical connection between each spring finger 32 and the circuit card.

While the above description of a card guide according to the present invention utilized oppositely disposed pairs of spring fingers, it will be apparent to those skilled in the art that the present invention may be constructed from non-opposed pairs of spring fingers. The key feature of the present invention is the use of two different types of resilient protuberances. The first type is positioned so as to create a channel having a width substantially equal to that of the circuit card and resists motion of the circuit card perpendicular to that channel with a first force. The second type is positioned so as to be forced in a direction perpendicular to the channel when the circuit card is inserted in the channel. The second type exerts a second force on the circuit board which is sufficient to provide electrical contact between the protuberance and the circuit board when the circuit board is inserted in the channel. The magnitude of the second force is less than that of the first force.

Card guides employing pairs of oppositely disposed spring fingers to both position and provide electrical contact are known to the prior art. However, these designs are unsatisfactory because of the use of the same type of protuberance for both positioning and contact functions. Such prior art designs would be equivalent to an embodiment of the present invention in which only spring fingers 34 were utilized and in which the distance between the spring fingers was less than the thickness of the circuit card. For proper positioning, the spring forces must be large so that the defined channel has a width essentially equal to the thickness of the circuit card when the circuit card is inserted in the card guide. To provide the electrical contact function, the channel width must be less than the thickness of the circuit card. Hence, prior art designs are forced to use a channel width which is less than thickness of the circuit card. When a circuit card is inserted in such a card guide, sufficient force must applied to the card to separate the spring fingers. This force has been found to be so high as to cause damage to the circuit card upon insertion or removal from these prior art card guides.

The present invention avoids these high forces since the spring fingers used for positioning are only forced apart in response to irregularities in the circuit. The electrical contacts are provided by spring fingers having relatively small spring constants. These fingers do not exert high forces on the circuit card even when these fingers are forced apart.

While the above described embodiments of the present invention have utilized protuberances which were positioned in opposing pairs, it will be apparent to those skilled in the art that the use of opposing pairs is not essential to practice of the present invention. The protuberances that define the channel for positioning the circuit card may be disposed in any manner which defines a channel having a width substantially equal to the thickness of the circuit card. For example, the protuberances could be positioned entirely on one side of the circuit card. In this case, the wall of channel 21 shown in FIG. 2 would define the other wall of the channel through which the circuit card slides.

The degree to which this channel may deviate from the circuit card width is determined by the tolerances with which the connector on the circuit card can be mis-positioned with respect to its mating connector on the backplane. In general, the connectors must be positioned with respect to each other to within some predetermined accuracy. The channel defined by the first protuberances must provide this positioning accuracy.

Similarly, embodiments in which the second type of protuberance is only present on one side of the circuit card will be apparent to those skilled in the art. In principle, a single protuberance of the second type could be positioned such that the insertion of the card into the card guide forced said protuberance toward the wall of the channel on which it was positioned with sufficient force to provide a good electrical contact.

There has been described herein a card guide. Various modifications to the present invention will become apparent to those skilled in the art from the foregoing description and accompanying drawings. Accordingly, the present invention is to be limited solely by the scope of the following claims.

What is claimed is:

1. A card guide for positioning a circuit card, said circuit card engaging said card guide along an edge thereof, said edge having a predetermined thickness, said card guide comprising:

means for defining a first channel having left and right walls and a width greater than said predetermined thickness;

a plurality of first resilient protuberances positioned along at least one of said left and right walls, said first protuberances defining a second channel having a width substantially equal to said predetermined thickness; and a second resilient electrically conducting protuberance positioned along one of said left and right walls, said second protuberance being positioned such that said protuberance is forced toward said wall on which said protuberance is positioned when said circuit card is inserted into said card guide.

2. The card guide of claim 1 wherein said first protuberances are positioned in opposing pairs, one member of each said pair being positioned on said right wall and the other member of each said pair being positioned on said left wall.

3. The card guide of claim 2 wherein said first protuberances comprise metallic springs having first spring constants, the distance between the members of said opposing pairs being substantially equal to the thickness of said circuit card.

4. The card guide of claim 3 wherein said second protuberance comprises a metallic spring having spring constant less than said spring constants of said first protuberances and being positioned such that said metallic spring engages said circuit card with a predetermined force when said circuit card is inserted in said card guide.

* * * * *